US010629112B2

(12) United States Patent
Kong

(10) Patent No.: US 10,629,112 B2
(45) Date of Patent: Apr. 21, 2020

(54) SIGNAL CONTROL DEVICE AND CONTROL METHOD, DISPLAY CONTROL DEVICE, AND DISPLAY DEVICE

(71) Applicants: BOE TECHNOLOGY GROUP CO., LTD., Beijing (CN); Fuzhou BOE Optoelectronics Technology Co., Ltd., Fujian (CN)

(72) Inventor: Xiaoli Kong, Beijing (CN)

(73) Assignees: BOE TECHNOLOGY GROUP., LTD., Beijing (CN); FUZHOU BOE OPTOELECTRONICS TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 16/043,066

(22) Filed: Jul. 23, 2018

(65) Prior Publication Data

US 2019/0206302 A1 Jul. 4, 2019

(30) Foreign Application Priority Data

Jan. 3, 2018 (CN) ..... 2018 1 0005203

(51) Int. Cl.
*G09G 3/20* (2006.01)

(52) U.S. Cl.
CPC ..... *G09G 3/2074* (2013.01); *G09G 3/20* (2013.01); *G09G 3/2011* (2013.01); *G09G 3/2014* (2013.01); *G09G 2310/0267* (2013.01); *G09G 2310/0275* (2013.01); *G09G 2320/0223* (2013.01)

(58) Field of Classification Search
CPC ... G09G 2320/0223; G09G 2320/0233; G09G 2320/045; G09G 2320/0242; G09G 2320/0285; G09G 2320/02; G09G 3/3648; G09G 3/3688; G09G 3/3233; G09G 3/3283; G09G 3/3696; G09G 2310/06; G09G 2310/0264; G09G 3/3266; G09G 3/3291; G09G 3/3611; G09G 2320/043; G09G 2320/0209; G09G 2320/041; G09G 2300/0866; G09G 2310/0202
See application file for complete search history.

(56) References Cited

U.S. PATENT DOCUMENTS

2009/0109197 A1* 4/2009 Tu ..... G09G 3/3674 345/204
2013/0314392 A1* 11/2013 Kim ..... G09G 3/20 345/212
2018/0182355 A1* 6/2018 Kobayashi ..... G09G 3/20
2018/0330655 A1* 11/2018 Tsuchi ..... G09G 3/2022

* cited by examiner

*Primary Examiner* — Dong Hui Liang
(74) *Attorney, Agent, or Firm* — McDermott Will & Emery LLP

(57) ABSTRACT

A signal control device includes a signal generator for generating an initial enable control signal and a pulse modulator connected to the signal generator for modulating pulse displacements of the initial enable control signal to obtain a modulated enable control signal. The pulse displacements of the modulated enable control signal increase in order in each scanning period, and the modulated enable control signal is used to control the output timings of display control signals.

10 Claims, 5 Drawing Sheets

SIGNAL CONTROL DEVICE AND CONTROL METHOD, DISPLAY CONTROL DEVICE, AND DISPLAY DEVICE

CROSS-REFERENCE TO RELATED APPLICATION

This application claims priority to Chinese Patent Application No. 201810005203.8, filed on Jan. 3, 2018, titled "A SIGNAL CONTROL DEVICE AND CONTROL METHOD, DISPLAY CONTROL DEVICE, AND DISPLAY DEVICE", which is incorporated herein by reference in its entirety.

TECHNICAL FIELD

The present disclosure relates to the field of display technologies, and in particular, to a signal control device and a control method, a display control device, and a display device.

BACKGROUND

When the display panel displays an image, the timing controller sends a timing signal to control the time for transmitting the scanning signal and data signal to the display panel, thereby realizing image display of the display panel.

SUMMARY

Some embodiments of the present disclosure provide a signal control device, which comprises: a signal generator configured to generate an initial enable control signal; and a pulse modulator connected to the signal generator and configured to modulate pulse displacements of the initial enable control signal, so as to obtain a modulated enable control signal, wherein the pulse displacements of the modulated enable control signal increase in order in each scanning period, and the modulated enable control signal is used to control output timings of display control signals.

In some embodiments, a pulse width of the modulated enable control signal is the same as a pulse width of the initial enable control signal, and a pulse amplitude of the modulated enable control signal is the same as a pulse amplitude of the initial enable control signal.

In some embodiments, the display control signals are scanning signals, and the modulated enable control signal is used to control the output timings of the scanning signals.

In some other embodiments, the display control signals are data signals, and the modulated enable control signal is used to control the output timings of the data signals.

In yet some other embodiments, the display control signals include scanning signals and data signals, and the modulated enable control signal is used to control the output timings of the scanning signals, and control the output timings of the data signals.

In some embodiments, the modulated enable control signal is used to control the output timings of the scanning signals, and in each scanning period, an on-time of each of thin film transistors corresponding to an nth scanning line in an array substrate is $T_n=T1+(n-1)\times t$, wherein T1 is an on-time of each of thin film transistors corresponding to a first scanning line in the array substrate, and t is a pulse width of each of pulses of the modulated enable control signal.

In some embodiments, the pulse modulator is configured to acquire at least two node pulses from the initial enable control signal in each scanning period, and set pulse emission timings for the at least two node pulses. The pulse modulator is further configured to use an interpolation method to process a pulse emission timing of each of node pulses in each scanning period, so as to obtain the modulated enable control signal; at least one pulse is between any two adjacent node pulses of the at least two node pulses.

In some embodiments, the signal control device further comprises a first storage element, a second storage element, and a voltage controller. The first storage element is configured to store the modulated enable control signal and transmit the modulated enable control signal in response to receiving a trigger signal. The second storage element is configured to store the display control signals. The voltage controller is configured to retrieve a display control signal of the display control signals under a control of the modulated enable control signal, and boost a voltage value of the display control signal to obtain a boosted display control signal, so that a voltage value of the boosted display control signal is greater than a threshold value of the display control signal.

Some embodiments of the present disclosure provide a signal control method, comprising: acquiring an initial enable control signal; modulating pulse displacements of the initial enable control signal to obtain a modulated enable control signal, wherein the pulse displacements of the modulated enable control signal increase in order in each scanning period; and controlling output timings of display control signals according to the modulated enable control signal.

In some embodiments, modulating the pulse displacements of the initial enable control signal to obtain the modulated enable control signal comprises: acquiring at least two node pulses from the initial enable control signal in each scanning period, wherein at least one pulse is between the at least two node pulses; setting pulse emission timings for the at least two node pulses, and using an interpolation method to process a pulse emission timing of each of node pulses in each scanning period to obtain the modulated enable control signal.

In some embodiments, controlling the output timings of the display control signals according to the modulated enable control signal comprises: storing the modulated enable control signal; retrieving the modulated enable control signal in response to receiving a trigger signal; acquiring a display control signal of the display control signals under a control of the modulated enable control signal; and boosting a voltage value of the display control signal to obtain a boosted display control signal, so that a voltage value of the boosted display control signal is greater than a threshold value of the display control signal; transmitting the boosted display control signal to a display driving circuit, so that the display driving circuit drives a display panel for display according to the boosted display control signal.

Some embodiments of the present disclosure provide a display control device, which comprises the signal control device as mentioned above, and the signal control device is connected to a display driving circuit.

Some embodiments of the present disclosure provide a display device, which comprises the display control device as mentioned above.

DETAILED DESCRIPTION

Technical solutions in embodiments of the present disclosure will be described clearly and completely below with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

In a large-sized display panel, due to a large resistance drop in an array substrate in the display panel, there will be higher losses in a signal during the transmission of the signal. Therefore, when the signal is transmitted to an area of the array substrate far from the signal terminal, it cannot meet the charging requirement of the sub-pixels in the area of the array substrate far from the signal terminal, resulting in a low charging rate in the thin-film transistors contained in the area of the array substrate far from the signal terminal. Consequently, the display effect of the display panel is reduced.

Figure 1:
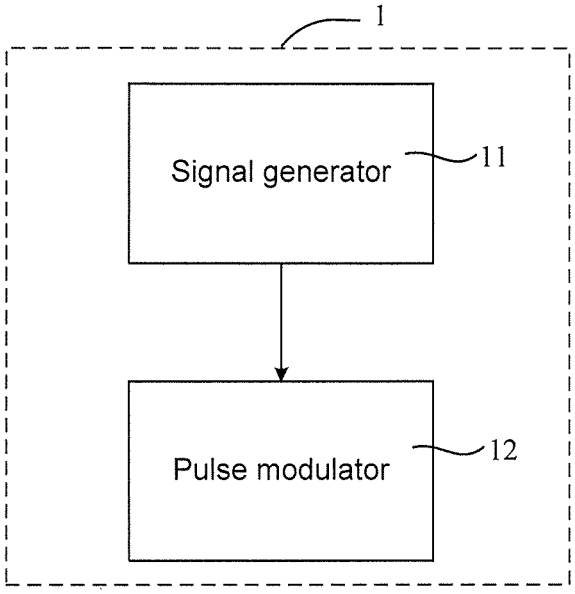
FIG. 1 is a schematic diagram of a signal control device according to some embodiments of the present disclosure.

In response to the above problem, some embodiments of the present disclosure provide a signal control device. As shown in FIG. 1, the signal control device 1 includes a signal generator 11 and a pulse modulator 12 connected to the signal generator 11. The signal generator 11 is configured to generate an initial enable control signal. The pulse modulator 12 is configured to modulate pulse displacements of the initial enable control signal, so as to obtain a modulated enable control signal. Pulse displacements of the modulated enable control signal increase in order in each scanning period, and the modulated enable control signal is used to control timings of display control signals.

In some embodiments, the signal generator 11 is implemented by a circuit. In some other embodiments, the signal generator 11 is implemented by a microprocessor programmed to perform one or more of the operations and/or functions described herein. In yet some other embodiments, the signal generator 11 is implemented in whole or in part by specially configured hardware (e.g., by one or more application-specific integrated circuits (ASIC(s)).

In some embodiments, the pulse modulator 12 is implemented by a circuit. In some other embodiments, the pulse modulator 12 is implemented by a microprocessor programmed to perform one or more of the operations and/or functions described herein. In yet some other embodiments, the pulse modulator 12 is implemented in whole or in part by specially configured hardware (e.g., by one or more application-specific integrated circuits (ASIC(s)).

Figure 2:
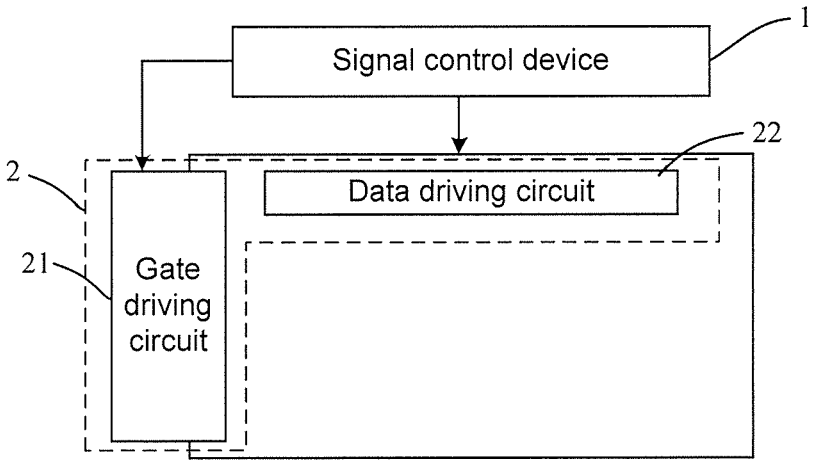
FIG. 2 is a schematic diagram of an application scenario of a signal control device according to some embodiments of the present disclosure.

As shown in FIG. 2, in some embodiments, the signal control device 1 is used in a display device, and the signal control device 1 is connected to a display driving circuit 2. The display driving circuit 2 is configured to output display control signals to the display panel under the control of the modulated enable control signal output from the signal control device 1, so as to drive the display panel for display.

In some embodiments, the display driving circuit 2 includes a gate driving circuit 21, and the display control signals are scanning signals. In some other embodiments, the display driving circuit 2 includes a data driving circuit 22, and the display control signals are data signals. In yet some other embodiments, the display driving circuit 2 includes a gate driving circuit 21 and a data driving circuit 22, and the display control signals includes scanning signals and data signals.

In some embodiments, the display driving circuit 2, the gate driving circuit 21, and the data driving circuit 22 are all composed of various electronic devices. In some embodiments, the display driving circuit 2 is implemented in whole or in part by specially configured hardware (e.g., by one or more application-specific integrated circuits).

The role of the modulated enable control signal is different depending on the display control signals controlled by the modulated enable control signal. In some examples, the display control signals are scanning signals, and the modulated enable control signal is used to control the output timings of the scanning signals. In some other examples, the display control signals are data signals, and the modulated enable control signal is used to control the output timings of the data signals. In yet some other examples, the display control signals includes scanning signals and data signals, and the modulated enable control signal is used to control the output timings of the scanning signals and the output timings of the data signals.

When the output timings of the display control signals are controlled by the pulse displacements of the modulated enable control signal respectively, the charging time of sub-pixels in the area of the array substrate close to the signal terminal will be relatively short, while the charging time of sub-pixels in the area far from the signal terminal will be relatively long, so that the charging rate of the sub-pixels in the area of the array substrate far from the signal terminal may be ensured, and the display effect of the display panel may be improved. In addition, since the pulse displacements of the modulated enable control signal increase in order in each scanning period, by controlling the output timings of the display control signals, the charging time of the sub-pixels in the array substrate farther from the signal terminal will be longer.

In some embodiments, the charging time of the sub-pixels is set according to their distance from the signal terminal. For example, when a sub-pixel is relatively close to the signal terminal, the charging time will be relatively short; and when the sub-pixel is relatively far from the signal terminal, the charging time will be relatively long.

Figure 3:
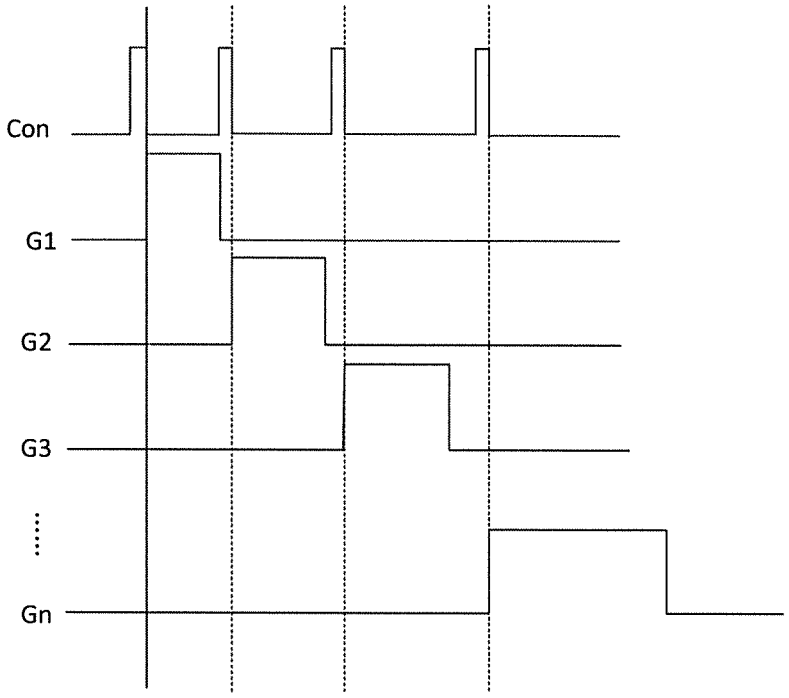
FIG. 3 is a timing diagram of a modulated enable control signal and scanning signals according to some embodiments of the present disclosure.

In some embodiments, the display control signals are scanning signals. As shown in FIG. 3, the output timings of the scanning signals are controlled by the modulated enable control signal Con, so that the durations of high-level signals (in some examples, each of the high-level signals turns on thin film transistors connected to a scanning line; in some other examples, low-level signals are used, and each of the low-level signals turns on the thin film transistors connected to the scanning line) on a first scanning line G1, a second scanning line G2, a third scanning line G3, up to a nth scanning line Gn increase in order, so that turn-on time of thin film transistors in rows of sub-pixels connected to the first scanning line G1, the second scanning line G2, the third scanning line G3, . . . and the nth scanning line Gn increase in order. Consequently, charging rates of sub-pixels in the area of the array substrate far from the signal terminal is ensured. The first scanning line G1 is close to the signal terminal, and n is a positive integer greater than or equal to 4.

Figure 4:
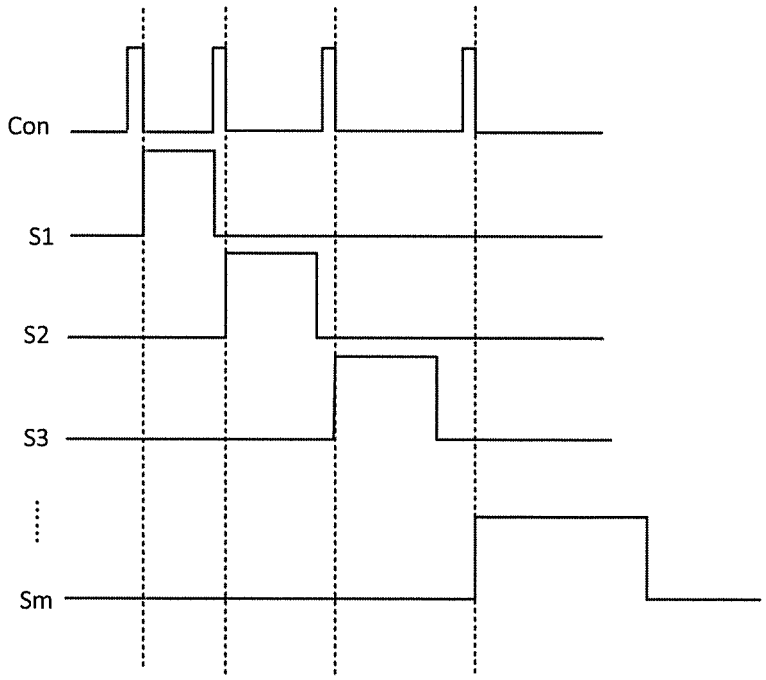
FIG. 4 is a timing diagram of a modulated enable control signal and data signals according to some embodiments of the present disclosure.

In some embodiments, the display control signals are data signals. As shown in FIG. 4, the output timings of the data signals are controlled by the modulated enable control signal, so that the durations of high-level signals (in some embodiments, low-level signals are used) on a first data line S1, a second data line S2, a third data line S3, up to an mth data line Sm increase in order, so that when a signal passes through a gate line, the charging time of sub-pixels connected to the first data line St the second data line S2, the third data line S3, . . . and the mth data line Sm increase in order. The first data line S1 is close to the signal terminal, and m is a positive integer greater than or equal to 4.

In the signal control device provided by the embodiments of the present disclosure, the signal generator 11 is used to generate an initial enable control signal, and the pulse modulator 12 is used to modulate the pulse displacements of the initial enable control signal, so as to obtain a modulated enable control signal. Moreover, the pulse displacements of the modulated enable control signal increase in order in each scanning period. Based on this, since the pulse displacements of the modulated enable control signal can be used to control output timings of the display control signals, the charging time of sub-pixels in the area close to the signal terminal will be relatively short, and the charging time of sub-pixels in the area far from the signal terminal will be relatively long. That is, the farther the sub-pixel from the signal terminal, the longer the charging time. Consequently, the charging rates of sub-pixels in the array substrate far from the signal terminal may be ensured, and the display effect of the display panel may be improved.

Since the charging rates of sub-pixels can be determined by the lengths of the pulse displacements corresponding to the modulated enable control signal, and are not related to pulse widths and pulse amplitudes, in some embodiments of the present disclosure, the pulse width of the modulated enable control signal is the same as the pulse width of the initial enable control signal, and the pulse amplitude of the modulated enable control signal is the same as the pulse amplitude of the initial enable control signal.

Considering that the on-time of the thin film transistors determines the charging time of sub-pixels, in some embodiments, in the case where the modulated enable control signal is used to control the output timings of the scanning signals, as shown in FIG. 3, in each scanning period, the on-time of each of thin film transistors corresponding to a nth scanning line in an array substrate is $T_n=T1+(n-1)\times t$. T1 is the on-time of each of the thin film transistors corresponding to a first scanning line in the array substrate, and t is a pulse width of a pulse of the modulated enable control signal Con. It can be seen from $T_n=T1+(n-1)\times t$ that, as the serial number of the scanning line increases, the on-time of each of the thin film transistors corresponding to the scanning line becomes longer.

In some embodiments, the duration of each scanning period is fixed, for example, the scanning period is 16.7 ms, 21 ms, or 24 ms. In addition, the total time for charging the sub-pixels corresponding to all the scanning lines is not longer than the duration of the scanning period.

As to how the pulse displacements of the modulated enable control signal determine the charging time of the sub-pixels by the display control signals, the implementation manners thereof are various.

In some embodiments, the pulse modulator 12 is configured to acquire at least two node pulses from the initial enable control signal in each scanning period, and set pulse emission timings of the at least two node pulses. In addition, the pulse modulator 12 is configured to use an interpolation method to process the pulse emission timing of each of node pulses in each scanning period, so as to obtain the modulated enable control signal, so that the pulse displacements of the modulated enable control signal increase in order and meet the charging requirement of each sub-pixel.

In some embodiments, the modulated enable control signal is used to control the output timings of the scanning signals. FIG. 3 shows a timing diagram of the modulated enable control signal Con and different scanning signals. As can be seen from FIG. 3, in one scanning period, according to a falling edge of a first pulse of the modulated enable control signal Con, a scanning signal on the first scanning line G1 turns on thin film transistors in sub-pixels connected to the scanning line, and the sub-pixels start to be charged. According to a falling edge of a second pulse of the modulated enable control signal Con, a scanning signal on the second scanning line G2 turns on thin film transistors in sub-pixels connected to the second scanning line, and the sub-pixels start to be charged. According to a falling edge of a third pulse of the modulated enable control signal Con, a scanning signal on the third scanning line G3 turns on thin film transistors in sub-pixels connected to the third scanning line, and the sub-pixels start to be charged, until according to a falling edge of an nth pulse of the modulated enable control signal Con, a scanning signal on the nth scanning line Gn turns on thin film transistors in sub-pixels connected to the nth scanning line, and the sub-pixels start to be charged.

Moreover, it can also be seen from FIG. 3 that high level durations of scanning signals used for turning on thin film transistors connected to their respective scanning line correspond to a pulse displacement process of the modulated enable control signal Con. Therefore, as the pulse displacements of the modulated enable control signal Con increase in order in each scanning period, a charging time of sub-pixels by the scanning signals corresponding to the pulse displacements also increases, which can increase a charging rate of sub-pixels relatively far from the signal terminal.

Figure 5:
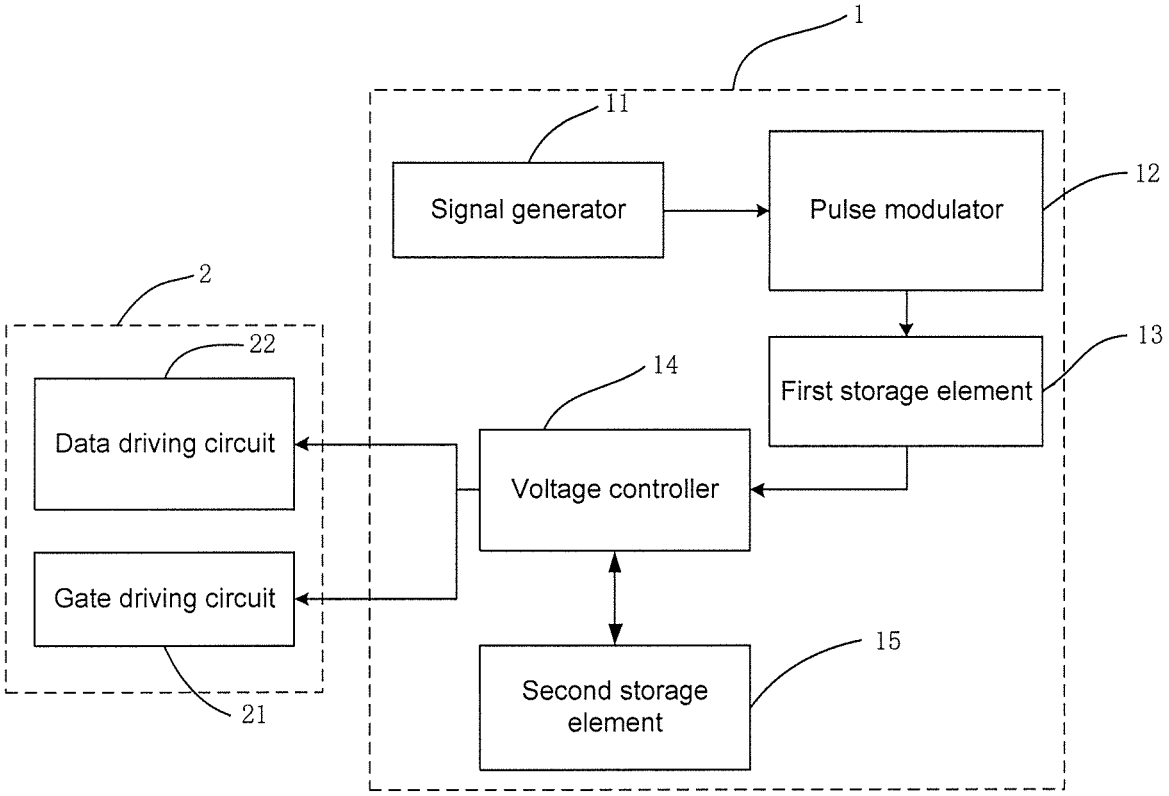
FIG. 5 is a schematic diagram of another signal control device according to some embodiments of the present disclosure.

Considering that the display control signal will become relatively weak due to severe loss in the transmission process, in some embodiments of the present disclosure, a voltage value of each of the display control signals is boosted to exceed a threshold value of each of the display control signals based on an Over Drive (OD) technology, so as to improve charging efficiencies of sub-pixels. Based on this, as shown in FIG. 5, in some embodiments, a signal control device 1 further includes a first storage element 13, a second storage element 15, and a voltage controller 14.

The first storage element 13 is configured to store the modulated enable control signal, and transmit the modulated enable control signal in response to receiving a trigger signal. The second storage element 15 is configured to store the display control signals. The voltage controller 14 is configured to retrieve a display control signal under the control of the modulated enable control signal, and boost a voltage value of the display control signal to obtain a boosted display control signal, so that the voltage value of the boosted display control signal is greater than a threshold value of the display control signal.

Figure 6:
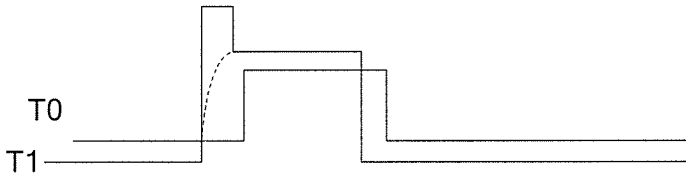
FIG. 6 is a comparison diagram before and after a voltage boost of a display control signal according to some embodiments of the present disclosure.

In some embodiments, as shown in FIG. 6, T0 is a display control signal stored in the second storage element 15, and the voltage controller 14 retrieves the display control signal T0 stored in the second storage element 15 and boosts a voltage value of the display control signal under the control of the modulated enable control signal stored in the first storage element 13 to obtain a boosted display control signal T1, so that the voltage value of the boosted display control signal is greater than a threshold value of the display control signal.

It will be noted that after the voltage value of the display control signal is boosted, there is a rapid automatic fallback process, and when the voltage falls back to the actual desired voltage value, the voltage value will become stable.

In this way, when the display control signal is transmitted to thin film transistors connected to a corresponding signal line (scanning line or data line), a voltage of an electrode end of each of the thin film transistors connected to the signal line will quickly reach a desired voltage. That is, after the display control signal is transmitted to the thin film transistors connected to the signal line, the voltage of the electrode end of each of the thin film transistors will quickly increase to a boosted voltage value, and then quickly falls down to a normal voltage value and becomes stable. In this way, it is possible to overcome the problem of signal delay (dotted line in FIG. 6) caused by the transmission of the display control signal to the thin film transistor through the signal line, thereby increasing the charging rates of sub-pixels.

In some embodiments, the modulated enable control signal is used to control the output timings of scanning signals, and the voltage controller 14 is configured to boost a voltage of each of the scanning signals to obtain boosted scanning signals, so that the voltage of each of the boosted scanning signals is greater than a threshold voltage of a corresponding one of the scanning signals. The threshold voltage of the corresponding one of the scanning signals is a voltage at which a thin film transistor is turned on. That is, the voltage of each of the boosted scanning signals is set to be greater than a normal voltage of a corresponding one of the scanning signals (the threshold voltage of the corresponding one of the scanning signals) by using the OD technology, so that when a boosted scanning signal passes through a corresponding scanning line to make a voltage of a gate of the corresponding thin film transistor reach the voltage of the boosted scanning signal, the thin film transistor can be turned on earlier (relative to a turn-on time of the thin film transistor that has not undergone the OD process). Then after a certain amount of loss, an actual turn-on voltage of the thin film transistor becomes stable. It can be seen that by using the OD technology to boost the voltage of the scanning signal, the thin film transistor may be turned on earlier; and although there is loss, the turn-on status of the thin film transistor will not be affected within the time range of the loss.

In some embodiments, the modulated enable control signal is used to control the output timings of data signals, and the voltage controller 14 can boost a voltage of each of the data signals to obtain boosted data signals, so that the voltage of each of the boosted data signal is greater than a threshold voltage of a corresponding one of the data signals. In some embodiments, grayscale correction is performed on the boosted data signals to increase a display brightness of a display panel.

The first storage element 13 and the second storage element 15 can be selected according to actual needs. For example, the first storage element 13 is a computer-readable recording/storage medium such as an electrically erasable programmable read-only memory (EEPROM), a read-only memory (ROM), a random access memory (RAM), or a flash memory. The second storage element 15 is a latch.

Figure 7:
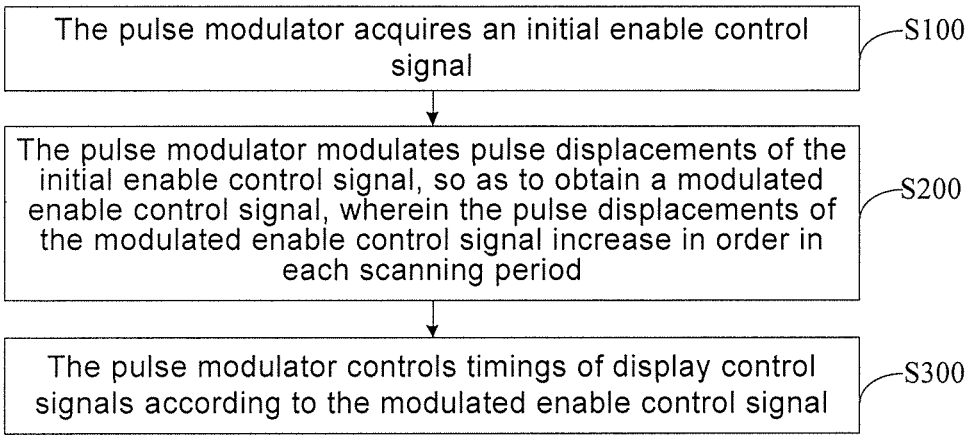
FIG. 7 is a flowchart of a signal control method according to some embodiments of the present disclosure.

Some embodiments of the present disclosure provide a signal control method. As shown in FIG. 7, the signal control method includes the following steps 100-300 (S100-S300).

In S100, the pulse modulator acquires an initial enable control signal.

In S200, the pulse modulator modulates pulse displacements of the initial enable control signal, so as to obtain a modulated enable control signal, wherein the pulse displacements of the modulated enable control signal increase in order in each scanning period.

In S300, the pulse modulator controls timings of display control signals according to the modulated enable control signal.

The advantageous effects of the signal control method provided by the embodiments of the present disclosure are the same as the advantageous effects of the signal control device 1 provided by the above embodiments, and will not be described in detail herein.

Figure 8:
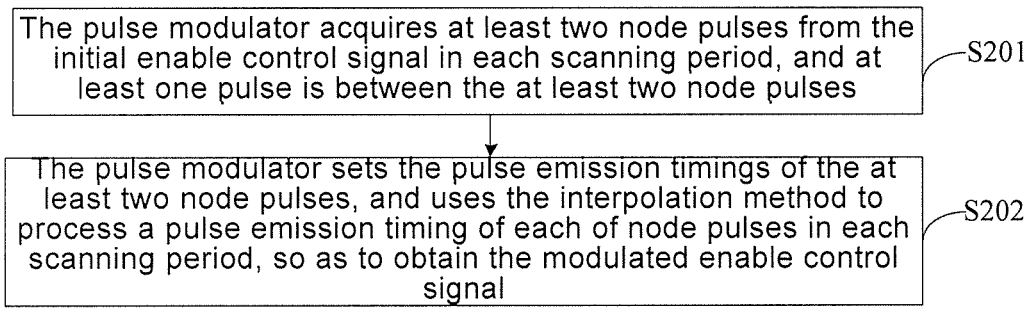
FIG. 8 is a flowchart of a method for modulating a pulse displacement of an initial enable control signal according to some embodiments of the present disclosure.

In some embodiments, as shown in FIG. 8, modulating pulse displacements of the initial enable control signal to obtain the modulated enable control signal includes steps 201-202 (S201-S202).

In S201, the pulse modulator acquires at least two node pulses from the initial enable control signal in each scanning period, and at least one pulse is between the at least two node pulses.

It will be understood that for any scanning period, if two node pulses are acquired from the initial enable control signal, the two node pulses are a first pulse and a last pulse in the scanning period. If more than two node pulses are acquired from the initial enable control signal, then according to a total number of the node pulses, one node pulse is acquired every other one or more pulses in addition to a first node pulse. That is, one or more pulses are between any two adjacent nodes in the more than two node pulses.

In S202, the pulse modulator sets the pulse emission timings of the at least two node pulses, and uses the interpolation method to process a pulse emission timing of each of node pulses in each scanning period, so as to obtain the modulated enable control signal.

Figure 9:
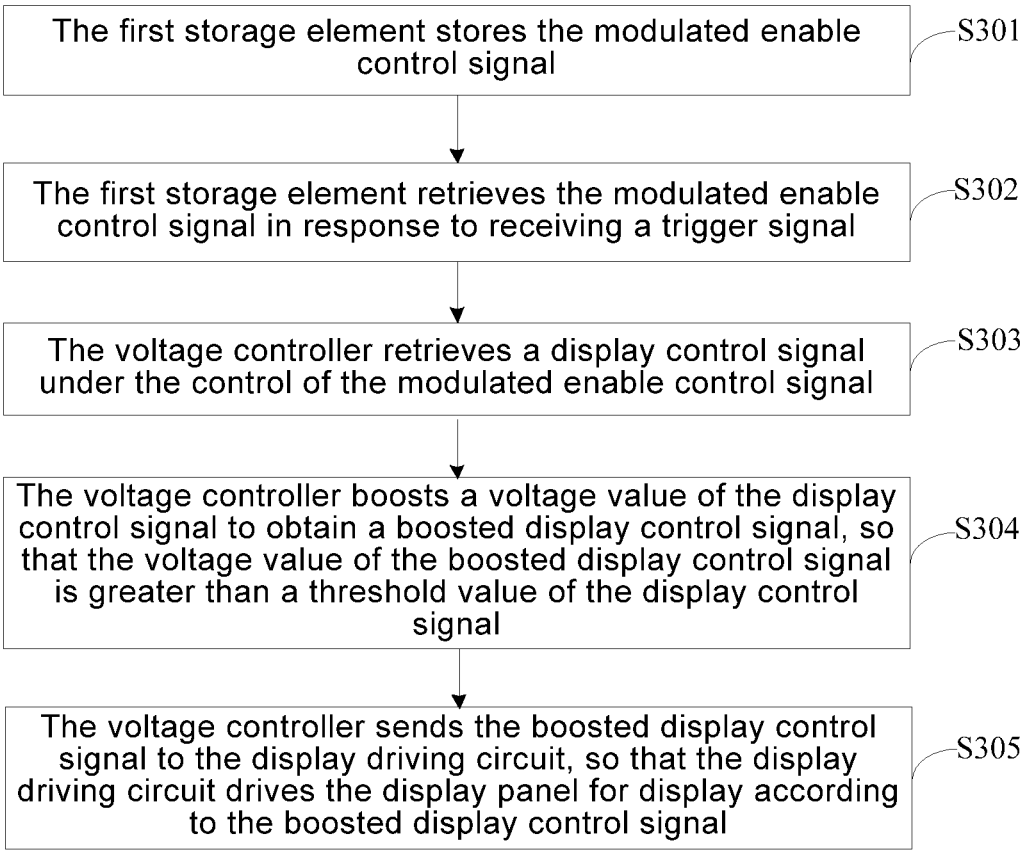
FIG. 9 is a flowchart of a method for controlling an output timing of a display control signal according to a modulated enable control signal according to some embodiments of the present disclosure.

In some embodiments, as shown in FIG. 9, controlling timings of display control signals according to the modulated enable control signal includes steps 301-305 (S301-305).

In S301, the first storage element stores the modulated enable control signal.

In S302, the first storage element retrieves the modulated enable control signal in response to receiving a trigger signal.

In S303, the voltage controller retrieves a display control signal under the control of the modulated enable control signal.

In S304, the voltage controller boosts a voltage value of the display control signal to obtain a boosted display control signal, so that the voltage value of the boosted display control signal is greater than a threshold value of the display control signal.

In S305, the voltage controller sends the boosted display control signal to the display driving circuit, so that the display driving circuit drives the display panel for display according to the boosted display control signal.

Some embodiments of the present disclosure also provide a display control device. As shown in FIG. 5, the display control device includes the signal control device 1 provided by the above embodiments, and the signal control device 1 is connected to a display driving circuit 2.

The advantageous effects of the display control device provided by the embodiments of the present disclosure are the same as the advantageous effects of the signal control device 1 provided by the above embodiments, and will not be described in detail herein.

In some embodiments, the display driving circuit 2 includes a gate driving circuit 21 and a data driving circuit 22, and the signal control device 1 is connected to the gate driving circuit 21 and the data driving circuit 22.

In some embodiments, the signal control device 1 includes a voltage controller 14, and the voltage controller 14 is connected to the gate driving circuit 21 and the data driving circuit 22, so as to ensure that the display control signals can be transmitted to the gate driving circuit 21 and the data driving circuit 22.

Figure 10:
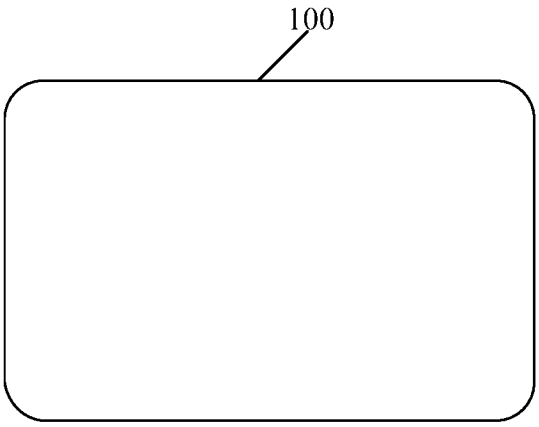
FIG. 10 is a schematic diagram of a display device according to some embodiments of the present disclosure.

Some embodiments of the present disclosure also provide a display device. As shown in FIG. 10, the display device 100 includes the display control device provided by the above embodiments.

The advantageous effects of the display device 100 provided by the embodiments of the present disclosure are the same as the advantageous effects of the signal control device 1 provided by the above embodiments, and will not be described in detail herein.

The display device is, for example, any product or component having a display function such as a mobile phone, a tablet computer, a television set, a display, a notebook computer, a digital photo frame, or a navigator.

In the above description of the implementation manners, specific features, structures, materials, or characteristics may be combined in any suitable manner in any one or more embodiments or examples.

The foregoing descriptions are merely some specific implementation manners of the present disclosure, but the protection scope of the present disclosure is not limited thereto, and the changes or replacements that any person skilled in the art can easily think of in the technical scope disclosed by the present disclosure should be within the protection scope of the present disclosure. Therefore, the protection scope of the present disclosure shall be subject to the protection scope of the claims.

What is claimed is:

1. A signal control device, comprising:

a signal generator configured to generate an initial enable control signal; and a pulse modulator connected to the signal generator and configured to modulate pulse displacements of the initial enable control signal, so as to obtain a modulated enable control signal, wherein the pulse displacements of the modulated enable control signal increase in order in each scanning period, and the modulated enable control signal is used to control output timings of display control signals;

a first storage element is configured to store the modulated enable control signal, and transmit the modulated enable control signal in response to receiving a trigger signal;

a second storage element is configured to store the display control signals;

a voltage controller is configured to retrieve a display control signal of the display control signals under a control of the modulated enable control signal and boost a voltage value of the display control signal to obtain a boosted display control signal, so that a voltage value of the boosted display control signal is greater than a threshold value of the display control signal.

2. A signal control method used in the signal control device according to claim 1, comprising:

acquiring an initial enable control signal;

modulating pulse displacements of the initial enable control signal to obtain a modulated enable control signal, wherein the pulse displacements of the modulated enable control signal increase in order in each scanning period; and controlling output timings of display control signals according to the modulated enable control signal.

3. The signal control method according to claim 2, wherein modulating the pulse displacements of the initial enable control signal to obtain the modulated enable control signal, comprises:

acquiring at least two node pulses from the initial enable control signal in each scanning period, wherein at least one pulse is between the at least two node pulses;

setting pulse emission timings of the at least two node pulses, and using an interpolation method to process a pulse emission timing of each of node pulses in each scanning period to obtain the modulated enable control signal.

4. The signal control method according to claim 2, wherein controlling the output timings of the display control signals according to the modulated enable control signal, comprises:

storing the modulated enable control signal;

retrieving the modulated enable control signal in response to receiving a trigger signal;

acquiring a display control signal of the display control signals under a control of the modulated enable control signal; and boosting a voltage value of the display control signal to obtain a boosted display control signal, so that a voltage value of the boosted display control signal is greater than a threshold value of the display control signal;

transmitting the boosted display control signal to a display driving circuit, so that the display driving circuit drives a display panel for display according to the boosted display control signal.

5. The signal control device according to claim 1, wherein the display control signals are scanning signals, and the modulated enable control signal is used to control the output timings of the scanning signals; and/or, the display control signal are data signals, and the modulated enable control signal is used to control the output timings of the data signals.

6. The signal control device according to claim 5, wherein the modulated enable control signal is used to control the output timings of scanning signals, and in each scanning period, an on-time of each of thin film transistors corresponding to an nth scanning line in an array substrate is $T_n = T1 + (n-1) \times t$, wherein T1 is an on-time of each of thin film transistors corresponding to a first scanning line in the array substrate, and t is a pulse width of each of pulses of the modulated enable control signal.

7. A display control device, comprising the signal control device according to claim 1, wherein the signal control device is connected to a display driving circuit.

8. A display device, comprising the display control device according to claim 7.

9. The signal control device according to claim 1, wherein a pulse width of the modulated enable control signal is the same as a pulse width of the initial enable control signal, and a pulse amplitude of the modulated enable control signal is the same as a pulse amplitude of the initial enable control signal.

10. The signal control device according to claim 1, wherein the pulse modulator is configured to acquire at least two node pulses from the initial enable control signal in each scanning period, set pulse emission timings for the at least two node pulses, and use an interpolation method to process a pulse emission timing of each of node pulses in each scanning period, so as to obtain the modulated enable control signals, and at least one pulse is between the at least two node pulses.

* * * * *